US005857317A

United States Patent [19]

Lee

[11] Patent Number: 5,857,317

[45] Date of Patent: Jan. 12, 1999

[54] COTTON FIBRES SUCTION PIPE OF SPINNING MACHINE

[76] Inventor: Fu-San Lee, P.O. Box 1-394, Chungho, Taipei Hsien, Taiwan

[21] Appl. No.: 845,279

[22] Filed: Apr. 26, 1997

[51] Int. Cl.[6] ..... D01H 5/28

[52] U.S. Cl. ..... 57/305; 57/304; 57/306

[58] Field of Search ..... 57/304, 305, 306

[56] References Cited

U.S. PATENT DOCUMENTS

| | | | |
|---|---|---|---|
| 2,669,744 | 2/1954 | Parrish | 57/304 |
| 2,893,196 | 7/1959 | Struber | 57/305 |
| 2,928,140 | 3/1960 | Powell | 57/304 |
| 3,381,462 | 5/1968 | Parker et al. | 57/305 |
| 3,755,849 | 9/1973 | Fink | 57/304 |
| 3,857,228 | 12/1974 | Nakahara et al. | 57/304 |
| 3,986,325 | 10/1976 | Ritter et al. | 57/305 |
| 4,022,006 | 5/1977 | Howorth | 57/305 |
| 4,693,069 | 9/1987 | Imhof et al. | 57/304 |

*Primary Examiner*—William Stryjewski
*Attorney, Agent, or Firm*—A & J

[57] ABSTRACT

This invention relates to a cotton fibers suction pipe of spinning machine, the side of the cotton fibers suction pipe having at least one or more guide discharge tubes connected to an air extracting pump, the circumference of the cotton fibers suction pipe having a plurality of suction holes, each suction hole being fitted with a bushing, the bushing being made of insulating materials, each bushing having a bush part and a covering flanges, the bush part can be pushed into the suction hole and the covering flange covering edge of the suction hole, thus cotton or yarn fibers can pass through smoothly the suction holes when they are inhaled into the cotton fibers suction holes, the bushings can prevent the cotton or yarn fibers from gathering or attaching on the suction holes because the bushings can't produce static electricity to suck cotton or yarn fibers, furthermore the covering flange can prevent cotton or yarn fibers from scraping the edge of the suction holes, operator only need to replace the worn-out bushing with new one and don't need to disassemble the whole cotton fibers suction pipe for cleaning or trimming.

1 Claim, 3 Drawing Sheets

COTTON FIBRES SUCTION PIPE OF SPINNING MACHINE

BACKGROUND OF THE INVENTION

This invention relates to a cotton fibers suction pipe of spinning machine, especially a cotton fibers suction pipe having a plurality of insulating bushings installed respectively in the suction holes so as to prevent cotton fibers from gathering or attaching on the suction holes, furthermore the insulating bushing having a covering flange covering the edge of the suction hole to prevent cotton fibers from scraping edge of the suction hole, thus operator only need to replace the worn-out bushing with new one and don't need to disassemble the whole cotton fibers suction pipe for cleaning or trimming.

The conventional cotton fibers suction pipe is shown as FIG. 1 and FIG. 2, the cotton fibers suction pipe (A) being installed on the spinning machine for removing the cotton fibers (D) of cotton threads (C), the circumference of the cotton fibers suction pipe (A) having a plurality of suction holes (A11) furthermore the side of the cotton fibers suction pipe (A) having a guide discharge tube (B) connected to an air extracting pump, and two ends of the cotton fibers suction pipe (A) being blocked with a sealing cap (A12) respectively, thus cotton fibers (D) of a cotton threads (C) can be inhaled into the cotton fibers suction pipe (A) from the suction holes (A11) when the cotton threads (C) passing through the side of the cotton fibers suction pipe (A). But the conventional cotton fibers suction pipe (A) being made of iron, thus cotton fibers (D) may attach on the suction holes (A11) because the cotton fibers (D) can produce static electricity when they pass through the suction holes (A11), furthermore the edge of each suction hole (A11) would produce a rough surface after used for a certain time, thus cotton fibers (D) may be hooked by the rough part formed at edge of these suction holes (A11), operator must disassemble the whole cotton fibers suction pipe (A) from spinning machine so as to clean the cotton fibers (D) gathered or attached in the suction holes (A11), then trimming the rough surface of these suction holes (A11). It is inconvenient for operator to disassemble the whole cotton fibers suction pipe for cleaning or trimming.

SUMMARY OF THE INVENTION

It is therefore the main object of this invention to provide a cotton fibers suction pipe of spinning machine, the side of the cotton fibers suction pipe having at least one or more guide discharge tubes connected to an air extracting pump, the circumference of the cotton fibers suction pipe having a plurality of suction holes, each suction hole being fitted with a bushing, the bushings being made of insulating materials, each bushing having a bush part and a covering flanges, the bush part can be pushed into the suction hole and the covering flange covering edge of the suction hole, thus cotton or yarn fibers can pass through smoothly the suction holes when they are inhaled into the cotton fibers suction holes, the bushings can prevent the cotton or yarn fibers from gathering or attaching on the suction holes because the bushings can't produce static electricity to suck cotton or yarn fibers, furthermore the covering flange can prevent cotton or yarn fibers from scraping the edge of the suction holes, thus operator only need to replace the worn-out bushing with new one and don't need disassemble the whole cotton fibers suction pipe for cleaning or trimming.

BRIEF DESCRIPTION OF THE DRAWINGS

In the drawings, which illustrate the preferred embodiments and modes of operation of the invention, and in which like reference characters designate the same or similar parts throughout the several views.

DETAILED DESCRIPTION OF THE PREFERRED EMBODIMENT

Figure 1:
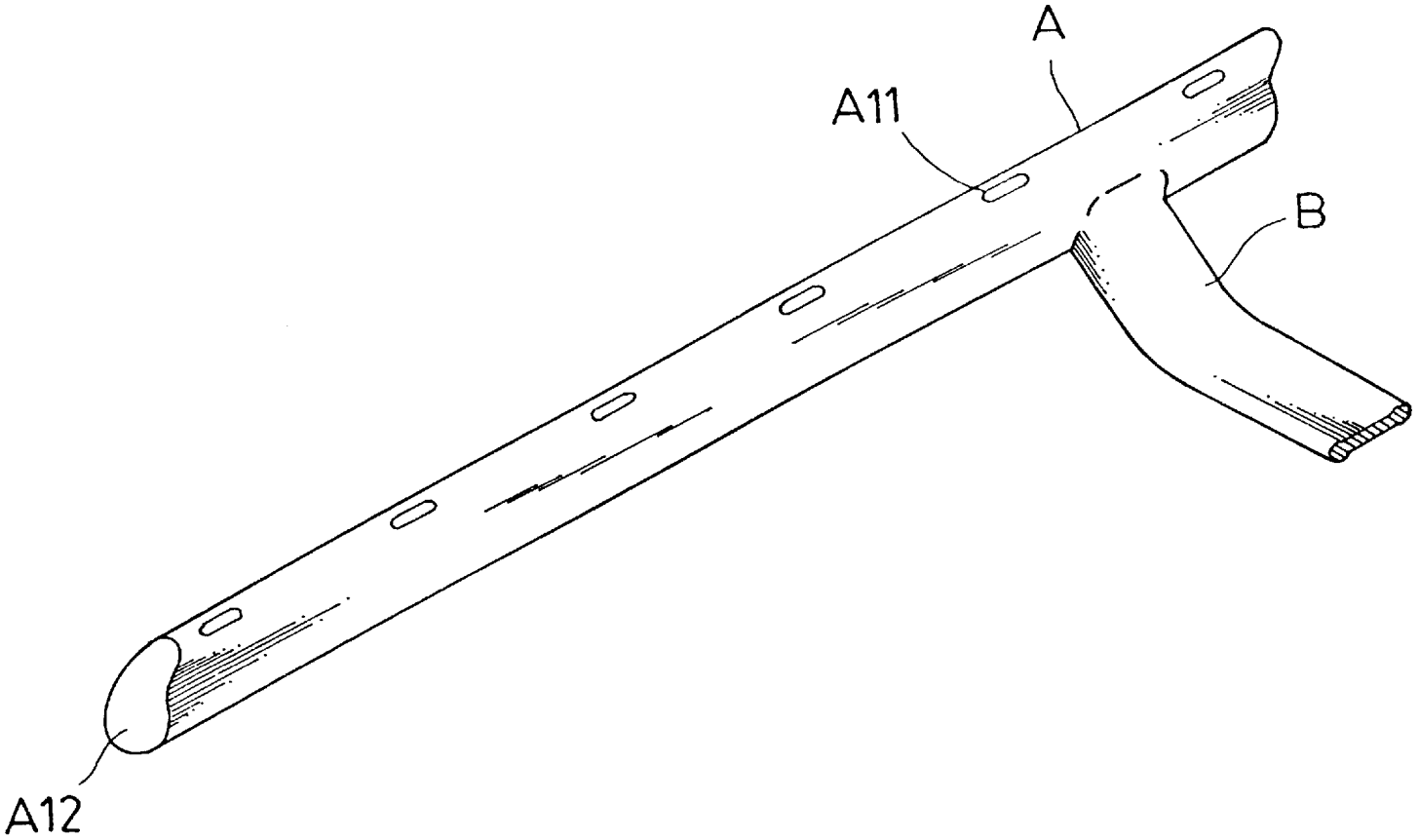
FIG. 1 is a perspective view showing an conventional cotton fibers suction pipe of spinning machine.
Figure 2:
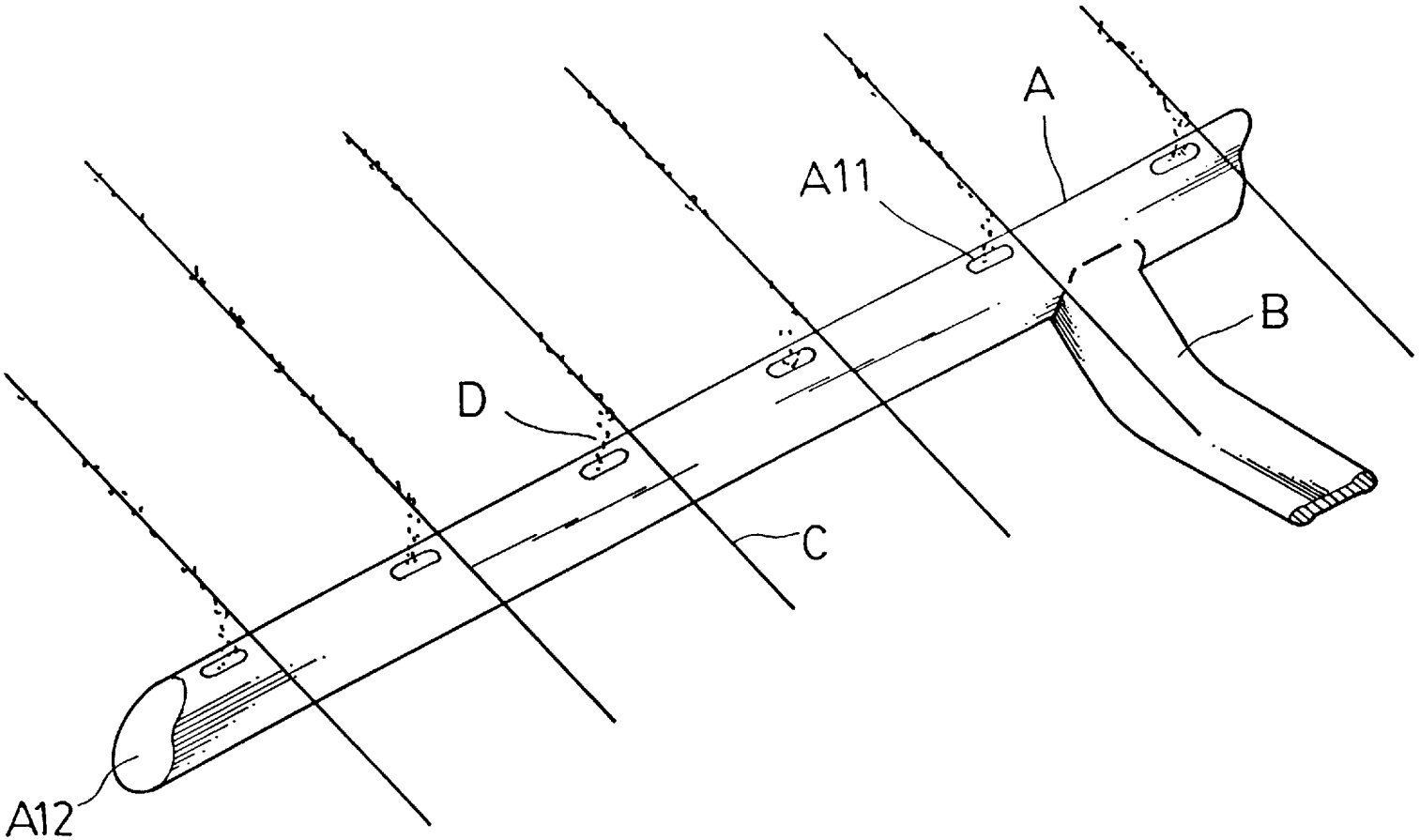
FIG. 2 is a perspective view showing an embodiment of the conventional cotton fibers suction pipe of spinning machine.
Figure 3:
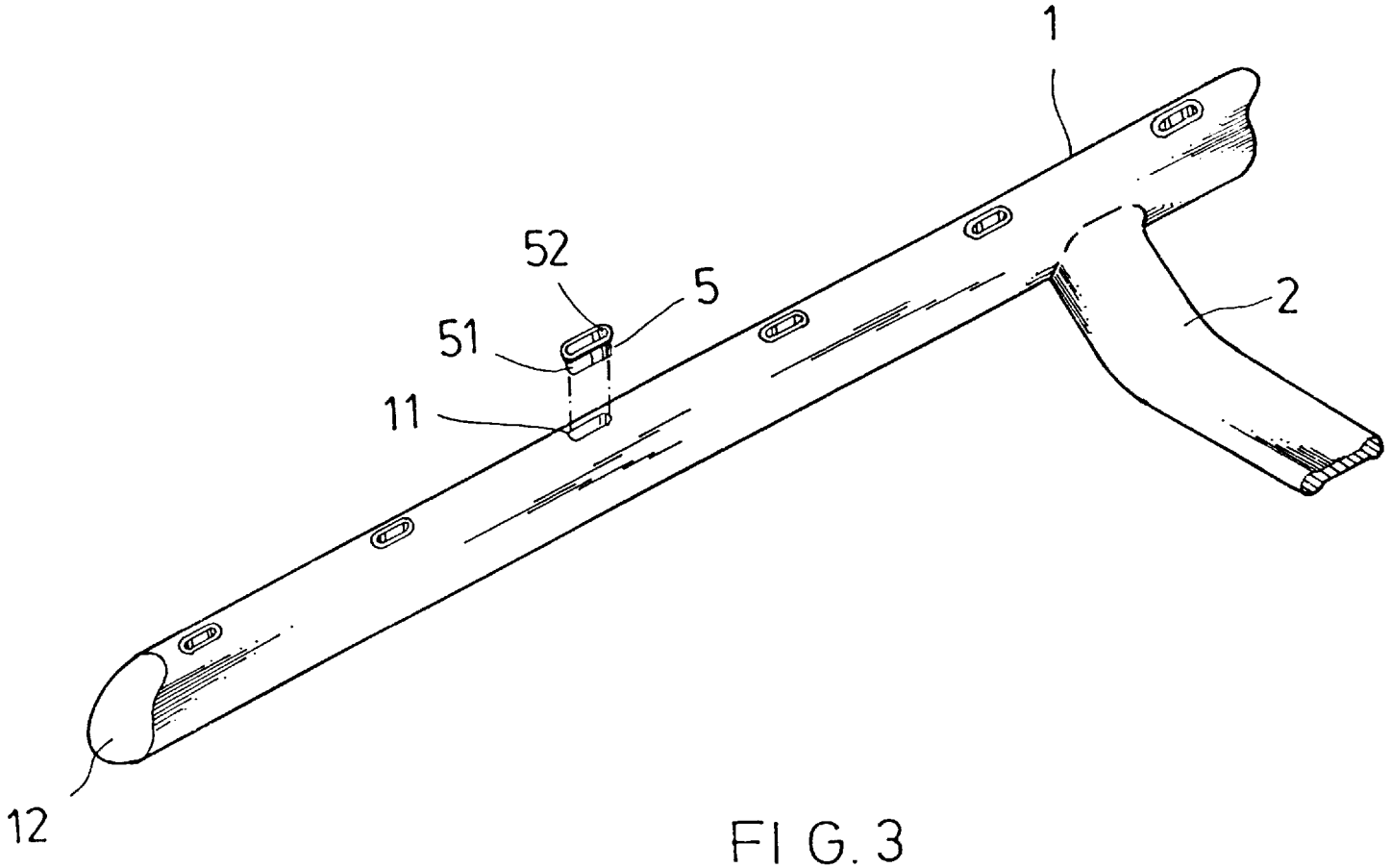
FIG. 3 is a perspective view showing a cotton fibers suction pipe of spinning machine of my present invention.

Referring to FIG. 3, the present invention relates to a cotton fibers suction pipe of spinning machine, the cotton fibers suction pipe (1) having at least one or more guide discharge tube (2) formed at its side, one end of the guide discharge tube (2) being led to the cotton fibers suction pipe (1), the other end being connected to an air extracting pump, two ends of the cotton fibers suction pipe (1) being blocked respectively with a sealing cap (12), furthermore on the circumference of the cotton fibers suction pipe (1) having a plurality of suction holes (11). Each suction hole (11) is fitted with a bushing (5), the bushing (5) being made of insulating materials, such as earthenware or bakelite etc., each bushing (5) having a bush part (51) and a covering flange (52). The diameter of the bush part (51) is bigger slightly then that of the suction hole (11), operator can push these bushings (5) respectively into the suction holes (11), furthermore the covering flange (52) of the bushing (5) can cover the edge of the suction hole (11), thus cotton or yarn fibers can pass through smoothly the suction holes (11) when they are inhaled into the cotton fibers suction pipe (1) by the air extracting pump, the bushings (5) can prevent the cotton or yarn fibers from gathering or attaching on the suction holes (11) because the bushings (5) are made of insulating materials and can't produce static electricity to suck the cotton or yarn fibers, furthermore the covering flange (52) of each bushing (5) can prevent the cotton or yarn fibers scraping the edge of the suction holes (11), operator only need to replace the worn-out bushing (5) with new one and don't need to disassemble the whole cotton fibers suction pipe (1) for cleaning or trimming.

It is understood by those skilled in the art that the foregoing description is a preferred embodiment of the disclosed device and that various changes and modifications may be made in the invention without departing from the spirit and scope thereof.

What is claimed is:

1. A suction pipe for cleaning cotton fibers in a spinning machine comprising:

at least a guide discharge tube having one end led to said cotton fibers suction pipe, said cotton fibers suction pipe having a circumference formed with a plurality of suction holes;

two sealing caps installed on two ends of said cotton fibers suction pipe to block; and a plurality of bushings installed respectively in said suction holes, each of said bushings having a bush part and a covering flange, said bush part being dimensioned to fit into a respective one of said suction holes, said covering flange being formed at a top edge of said bush part to cover the entire edge of said suction hole wherein the bushing covers the suction hole from the cotton fibers entering the suction pipe.

* * * * *